US005274199A

United States Patent [19]

Uryu et al.

[11] Patent Number: 5,274,199

[45] Date of Patent: Dec. 28, 1993

[54] ACOUSTIC DIAPHRAGM AND METHOD FOR PRODUCING SAME

[75] Inventors: Masaru Uryu, Chiba; Noboru Kurihara, Kanagawa, both of Japan

[73] Assignee: Sony Corporation, Tokyo, Japan

[21] Appl. No.: 49,970

[22] Filed: Apr. 20, 1993

Related U.S. Application Data

[63] Continuation of Ser. No. 694,409, May 1, 1991, abandoned.

[30] Foreign Application Priority Data

May 18, 1990 [JP] Japan ..... 2-126819

[51] Int. Cl.[5] ..... G10K 13/00

[52] U.S. Cl. ..... 181/169; 181/170

[58] Field of Search ..... 181/167, 169, 170; 428/260, 245, 265, 272, 252; 106/163.1

[56] References Cited

U.S. PATENT DOCUMENTS

| | | | |
|---|---|---|---|
| 3,935,924 | 2/1976 | Nagao et al. | 181/169 |
| 4,742,164 | 3/1988 | Iguchi et al. | 106/163.1 |
| 5,031,720 | 7/1991 | Ohta et al. | 181/169 |

OTHER PUBLICATIONS

Patent Abstracts of Japan, vol. 11, No. 145, Dec. 12, 1986 (Masatoshi).

Patent Abstracts of Japan, vol. 8, No. 277, Aug. 18, 1984 (Takanori).

*Primary Examiner*—Michael L. Gellner

*Assistant Examiner*—Khanh Dang

*Attorney, Agent, or Firm*—Lewis H. Eslinger; Jay H. Maioli

[57] ABSTRACT

An acoustic diaphragm is obtained by forming micro-fibrillated cellulose into a web by a process similar to a paper-making process. The micro-fibrillated cellulose is the cellulose obtained by beating to the Canadian standard freeness of not more than 300 ml, or bacterial cellulose. Since the micro-fibrillated cellulose is poor in wet strength, it is reinforced by a reinforcement element and, in this state, is formed into the web on a wire screen. The reinforcement element may be detached after forming the web, or may be left laminated with the cellulose web so that the resulting composite product is used as the acoustic diaphragm.

7 Claims, 1 Drawing Sheet

ACOUSTIC DIAPHRAGM AND METHOD FOR PRODUCING SAME

This is a continuation of application Ser. No. 07/694,409, filed May 1, 1991, now abandoned.

BACKGROUND OF THE INVENTION

This invention relates to an acoustic diaphragm used for a loudspeaker or the like and a method for producing such diaphragm. More particularly, it relates to an acoustic diaphragm employing a micro-fibrillated cellulose and a method for producing such diaphragm.

Up to now, cone paper made from pulp has been used extensively for an acoustic diaphragm for a loudspeaker or the like.

The cone paper is fabricated through the process steps of beating the pulp, dispersing and swelling the beaten pulp in water, and forming the pulp dispersed in water to the desired web shape by a process similar to a paper making process. However, the web obtained by simply dispersing the pulp obtained from wood in water by the process similar to the paper-making process can hardly be used as a diaphragm because it is destitute of a crisp feel and inferior in mechanical strength. The reason is that individual fibers making up the pulp are not affixed strongly together.

The affixing force may be developed by softening and disintegrating the fibers and into component fibrils (fibrillation) for increasing the number of contact points between the fibers for increasing the number of hydrogen bonds.

Such mechanical fibrillation of the individual fibers is termed beating and is usually performed by an apparatus known as a beater.

Meanwhile, a higher longitudinal wave propagating velocity or a higher sound propagating velocity C is required of the acoustic diaphragm, so that a material which is light and has a large Young's modulus may be advantageously employed as the diaphragm material.

The physical properties of the come paper, such as the Young's modulus or tensile strength, are determined by the degree of beating, as mentioned above, such that, in order to produce the cone paper exhibiting the higher values of the Young's modulus, it is necessary to employ a cellulose exhibiting the advanced degree of beating and hence of fibrillation. In other words, it is thought that, in the cone paper used as the diaphragm material, the higher the beating degree of the cellulose used for making the web, the higher becomes the Young's modulus of the cone paper.

However, if the cellulose used for making the web of the cone paper is beaten to a higher degree, the strength of the cellulose in the wet state during the web-making process is drastically lowered, so that difficulties are presented with respect to handling and shape retention. For example, if it is attempted to transfer the formed web in the wet state to another metallic mold, the web may be collapsed in shape.

On the other hand, the cellulose tends to be intruded into the meshes of the wire screen of a web-making apparatus, so that, when it is attempted to peel off the formed web (cone paper) from the wire screen after drying, an excess force tends to be applied momentarily to the web to destroy the web due to the higher rigidity of the wire screen of the web-forming apparatus.

On the other hand, when a flat web is formed and molded to a desired shape by press working with the aid of a metallic mold, an excess force must be used that tends to destroy the web.

Therefore, owing to production difficulties, it is thought to be difficult to make the web for the acoustic diaphragm from the cellulose which has been fibrillated to an excessively high extent even though such high degree of fibrillation is expected to be desirable from the viewpoint of characteristics. Above all, it is thought to be extremely difficult to produce the diaphragm with a reduced thickness.

OBJECTS AND SUMMARY OF THE INVENTION

It is therefore a principal object of the present invention to provide an acoustic diaphragm having superior physical properties, such as Young's modulus and tensile strength.

It is another object of the present invention to provide a method for producing an acoustic diaphragm wherein the web of the cone paper may be handled even though the web has a low wet strength, and wherein the acoustic diaphragm having a high Young's modulus may be formed from the micro-fibrillated cellulase.

In accordance with the present invention, there is provided an acoustic diaphragm obtained by forming micro-fibrillated cellulose into a web by a process similar to a paper-making process.

According to the present invention, there is also provided an acoustic diaphragm wherein a web of micro-fibrillated cellulose and a reinforcement element are laminated one upon the other.

According to the present invention, there is also provided a method for producing an acoustic diaphragm comprising placing a reinforcement element on a wire screen and forming cellulose having a Canadian standard freeness of not more than 300 ml on said reinforcement element for forming a composite web.

According to the present invention, the acoustic diaphragm having superior physical properties, such as Young's modulus and tensile strength, is provided by making a web for the diaphragm from the micro-fibrillated cellulose.

According to the present invention, the web for the diaphragm is formed from the micro-fibrillated cellulose, by a process similar to a paper-making process, by reinforcing the cellulose by a reinforcement element placed on a wire screen of a web-forming apparatus. Thus, the web may be handled even if the web exhibits a low wet strength, so that the acoustic diaphragm having superior physical properties may be produced with high profitability.

Since the cone paper of the acoustic diaphragm of the present invention is constituted by micro-fibrillated cellulose, the number of contact points between the fibers and hence the number of hydrogen bonds may be increased to improve the physical properties of the diaphragm, such as the Young's modulus or the tensile strength. Moreover, the cellulose is superimposed on and unified with the reinforcing element for further improving the mechanical strength of the cone paper.

On the other hand, in accordance with the process for producing the acoustic diaphragm of the present invention, the micro-fibrillated cellulose is formed into a web on the reinforcement member placed on the web-forming wire screen. It is noted that the web formed from the micro-fibrillated cellulose, even though it is low in wet strength, is reinforced by the above mentioned reinforcing member, so that it may be handled easily even under the wet state, while the web shape may be retained.

When peeling the reinforced member from the web after drying, the reinforcing member may be gradually peeled off from the web because of pliability of the reinforcing member, without application of an inadvertently large force to the web.

BRIEF DESCRIPTION OF THE DRAWINGS

FIGS. 2A to 2C show the process for producing a dome-shaped diaphragm by a drawing press, wherein FIG. 2A is a diagrammatic cross-sectional view showing a cellulose-woven cloth composite body in the form of a flat plate;

FIG. 2B is a diagrammatic cross-sectional view showing a drawing press working process; and FIG. 2C is a diagrammatic cross-sectional view showing the cellulose-woven cloth composite body molded to a dome shape.

DETAILED DESCRIPTION OF THE INVENTION

Figure 1:
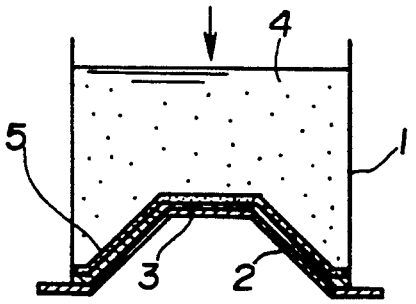
FIG. 1 is a diagrammatic cross-sectional view showing the web-forming process with the aid of a cone-shaped wire screen.

The cellulose employed for web making according to the present invention is the highly micro-fibrillated cellulose which herein has value of the Canadian standard freeness of not more than 300 ml. The cellulose having the value of the Canadian standard freeness of not more than 300 ml is to be used because, with the value of the Canadian standard freeness in excess of 300 ml, the produced web of the acoustic diaphragm has an insufficient Young's modulus.

Among the celluloses having the Canadian standard freeness of not more than 300 ml, referred to hereinafter as the micro-fibrillated cellulose, is beaten pulp, that is, the pulp mechanically beaten by a beater. The value of the Canadian standard freeness of not more than 300 ml may be reached easily by suitably setting the beating conditions by the beater, such as the beating time or the intensity of the force applied during beating.

The bacterial cellulose microbially produced by culturing certain types of bacteria under predetermined conditions may also be used advantageously as the micro-fibrillated cellulose.

The above mentioned bacterial cellulose is constituted by α-cellulose having high crystallinity and exhibits extremely high strength owing to its extremely strong superficial orientation properties. Also it is only 200 to 500 angstroms thick and hence is extremely thin.

Typical of the bacteria producing the bacterial cellulose is the acetic acid bacteria, examples thereof being *Acetobacter aceti, Acetobacter xylinum, Acetobacter rancens, Sarcina ventriculi, Bacterium xyloides, Acetobacter pasteurianus* and *Agrobacterium tumefaciens*. Further examples of the bacteria are those belonging to the genus Pseudomonas and the genus Rhizobium.

The above mentioned bacterial cellulose may be produced as a gel-like substance of a certain thickness in the interface between the culture surface and the air, or by an aeration and agitation culture. The produced bacterial cellulose may be disaggregated in water to form a web.

For forming the web, high-polymer fibers such as carbon fibers, glass fibers, aramide fibers, polyolefin fibers, ultra-drawn polyolefin resins or polyester resins, may be mixed as reinforcements into the micro-fibrillated cellulose. Additives for paper, such as so-called sizing agents or fillers, may also be added to the micro-fibrillated cellulose, if necessary or desired.

On the other hand, a reinforcement element placed on the wire screen is employed to make up for the wet strength of the web formed from the micro-fibrillated cellulose. For example, woven or non-woven cloths exhibiting certain pliability or flexibility may be conveniently employed as the reinforcement element.

The material type or the thickness of the woven or non-woven cloths may be arbitrarily selected if the element is used simply as the reinforcement of the web. However, if the woven or non-woven cloths are directly unified with the web of the micro-fibrillated cellulose, as will be explained later, the material type or the thickness of the element may be selected as a function of the desired properties of the acoustic diaphragm. Meanwhile, if the reinforcement element is used simply as the reinforcement for the web, it is preferred that the reinforcement elements, such as the woven or non-woven cloth, be readily peeled off from the micro-fibrillated cellulose. On the other hand, if the reinforcement element is to be directly unified with the web of the micro-fibrillated cellulose, it is preferred that the elements be readily brought into tight contact with the micro-fibrillated cellulose, while being of a higher strength and a higher modulus of elasticity.

More specifically, woven or non-woven cloths of carbon fibers, glass fibers, polyester fibers, aramide fibers or silk, may be selectively employed by taking the above requirements into account.

According to the present invention, the micro-fibrillated fibers may be formed into a web by first placing a wire screen 2 on the bottom of a paper-making machine 1, as shown in FIG. 1, placing the above mentioned reinforcement element 3 on the wire screen 2, and supplying thereto a liquid suspension 4 containing the micro-fibrillated cellulose dispersed therein to produce a web 5.

The web 5 thus produced is supplied to a drying step for drying. At this time, the web 5 formed by micro-fibrillated cellulose may be transferred to the drying process while it is placed on the wire screen 2. Alternatively, the web may be detached from the wire screen 2 along with the reinforcement element 3 and re-placed on another metal mold before the web is transferred to the drying process. In the latter case, since the web 5 formed by the micro-fibrillated cellulose is handled simultaneously with the reinforcement element 3, there is no risk of destruction or warping of the web 5 even though the web has inferior wet strength.

After drying, the reinforcement element may be peeled off from the web of the micro-fibrillated cellulose (cone paper) so that the web formed solely by the micro-fibrillated cellulose may be used as the acoustic diaphragm. Alternatively, the reinforcement element may be unified directly to the web so that the resulting web-woven fabric or web-non-woven fabric composite body may be used as the composite acoustic diaphragm.

With the above described method, the shape of the resulting cone paper is determined by the shape of the wire screen 2. However, according to the present invention, the web of the micro-fibrillated cellulose in the form of a flat plate may be imparted a desired shape by drawing with the use of, for example, a metallic mold.

In any of the above methods, an ordinary wire screen 2 may be employed, such as a wire mesh or a punched or perforated metallic plate.

It will be seen from the description set out above that, by using a web of the micro-fibrillated cellulose and laminatingly unifying the reinforcing element to the web, there may be provided an acoustic diaphragm which has been significantly improved in physical properties, such as the Young's modulus or tensile strength.

Also, in accordance with the method of the present invention, since the reinforcement element is placed on the wire screen and the cellulose is placed on the reinforcement element for web making, the cellulose having a lower wet strength, such as micro-fibrillated cellulose, may be handled easily, so that the acoustic diaphragm with a high Young's modulus may be produced efficiently.

In addition, in accordance with the method of the present invention, a diaphragm formed of a composite material formed by the micro-fibrillated cellulose and various additives, if desired, may be produced easily with various desired properties according to the intended usage and applications.

The present invention will be hereinafter explained with reference to several illustrative Examples.

EXAMPLE 1

Figure 2A:
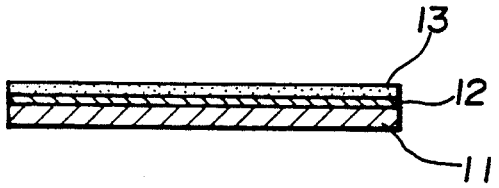

The bacterial cellulose produced by acetic acid bacteria was disaggregated using a mixer. The disaggregated cellulose was formed into a web on a web-forming wire screen 11 fitted with a woven polyester fiber cloth 12 as shown in FIG. 2A. The web thus formed was formed by the cellulose 13 and the woven cloth 12. In the web-forming process, the micro-fibrillated cellulose was the disaggregated bacterial cellulose produced by the acetic acid bacteria, while the woven polyester fiber cloth 12, used as the reinforcement element, was the product NO 120S with a 100 mesh size (pore diameter, 200 μm) manufactured by NBC Co. Ltd. The concentration of the web was 1 g/l. The drying conditions were five minutes of drying with a mold temperature of 140° C.

Figure 2B:
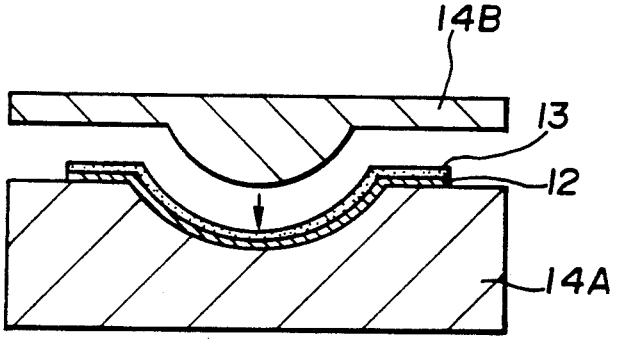
Figure 2C:
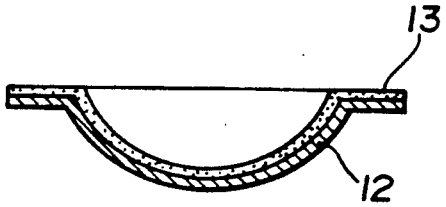

Then, as shown in FIG. 2B, the composite body of the cellulose 13 and the woven cloth 12 was processed by drawing by means of a metal mold half 14A having a hemispherical recess and a mating metal mold half 14B having a projection in register with the recess to produce a dome-shaped composite diaphragm as shown in FIG. 2C.

EXAMPLE 2

The web-forming and drawing process steps were carried out in the same way as in Example 1. The woven polyester fiber cloth 12 was then peeled off from the cellulose to produce a dome-shaped diaphragm formed solely by the cellulose 13.

EXAMPLE 3

The bleached Kraft pulp (N. B. KP) from needle-leaved trees was beaten by a Hollender type beater to the Canadian standard freeness of 300 ml and processed by web forming and drawing process steps in the same way as in Example 1 to produce a composite diaphragm formed by the cellulose and the polyester fibers.

It is noted that, in the above Examples 1 and 3, a binder manufactured by Nippon Zeon Co. Ltd. under the trade name of Nipol Latex and a yield improver (wet web strength improver) manufactured by Dick Hercules Co. Ltd. under the trade name of Kaimen 557-N, were added to the liquid cellulose suspension prior to being formed into a web, in amounts of 10 wt. % and 5 wt. % related to the quantity of the solid cellulose, respectively, for improving adhesion between the cellulose and the woven polyester fiber cloth.

The internal loss (tan δ), Young's modulus E and the sound velocity C were measured of the diaphragm obtained by the above technique in accordance with the vibration reed method. The results are shown in the following Table. The results obtained with a customary paper diaphragm, produced by forming the cellulose having the Canadian standard freeness of 560 ml, are also shown in the Table by way of a comparative Example.

TABLE

| | tan δ | E(Gpa) | C(m/sec) |
|---|---|---|---|
| embodiment 1 | 0.07 | 6.7 | 2590 |
| embodiment 2 | 0.05 | 8.5 | 2940 |
| embodiment 3 | 0.08 | 4.1 | 2350 |
| comparative | 0.07 | 2.3 | 2140 |

Comparison between the characteristics of the diaphragm obtained in the Examples and those of the customary paper diaphragm shows that the Young's modulus obtained in the Examples 1 to 3 is two or three times that obtained with the conventional paper diaphragm according to Comparative Example.

In addition, since the diaphragms of the Examples 1 to 3 are film-shaped and free of pin holes, in distinction from the conventional paper diaphragm, so that the coating or impregnation of a joint-filling material, indispensable is a paper diaphragm, may be dispensed with, it becomes possible to produce a thin-film diaphragm with a thickness of the order of 10 μm.

What is claimed is:

1. A loudspeaker diaphragm comprising:

a micro-fibrillated cellulose element formed by a paper making process of a micro-filbrillated cellulose having a Canadian standard freeness value of not more than 300 ml and said cellulose element having an outer convex surface and a recess molded therein; and a reinforcement element laminated to an outer, convex surface of said cellulose element opposite said recess, wherein said reinforcement comprises a cloth made from the group consisting of carbon fibers, glass fibers, polyester fibers, aramide fibers and silk.

2. A loudspeaker diaphragm according to claim 1, wherein said cloth is woven.

3. A loudspeaker diaphragm according to claim 1, wherein said cloth is non-woven.

4. A loudspeaker diaphragm according to claim 1, wherein said cellulose element has a Young's modulus of elasticity in the range of 6.7 to 8.5 Gpa.

5. A loudspeaker diaphragm according to claim 1, wherein said cellulose element has a thickness on the order of 10 μm.

6. A loudspeaker diaphragm according to claim 1, wherein said recess molded in said cellulose element is hemispherical.

7. A loudspeaker diaphragm according to claim 1, wherein said recess molded in said cellulose element is conical.

* * * * *